United States Patent [19]

White et al.

[11] 4,211,001

[45] Jul. 8, 1980

[54] CONTACT LOADING APPARATUS

[75] Inventors: William G. White, Burbank, Ill.; Verle D. Johnson, Corydon, Ind.

[73] Assignee: Bunker Ramo Corporation, Oak Brook, Ill.

[21] Appl. No.: 895,836

[22] Filed: Apr. 13, 1978

[51] Int. Cl.[2] ..... H01R 43/00

[52] U.S. Cl. ..... 29/747; 29/759; 29/761; 29/837

[58] Field of Search ..... 29/739, 747, 755, 759, 29/761, 629

[56] References Cited

U.S. PATENT DOCUMENTS

| | | | |
|---|---|---|---|
| 2,968,809 | 1/1961 | Foreman et al. | 29/741 |
| 2,970,370 | 2/1961 | Weaver et al. | 227/95 |
| 3,545,606 | 12/1970 | Bennett et al. | 29/739 X |
| 3,611,562 | 10/1971 | Herb | 29/626 |
| 3,636,624 | 1/1972 | Bates | 29/626 |
| 3,664,015 | 5/1972 | Bakermans | 29/625 |
| 3,699,631 | 10/1972 | Shughart | 29/739 |
| 3,713,197 | 1/1973 | Crump | 29/739 |
| 3,739,446 | 6/1973 | Long, Jr. et al. | 29/739 |
| 3,763,540 | 10/1973 | Long, Jr. | 29/739 |
| 3,797,090 | 3/1974 | Boutcher et al. | 29/739 |
| 3,852,866 | 12/1974 | Johnson | 29/739 |
| 3,875,636 | 4/1975 | Shultz, Jr. et al. | 29/739 |
| 3,924,325 | 12/1975 | Kufner | 29/747 X |
| 3,955,414 | 5/1976 | Anderson | 29/747 |
| 4,041,589 | 8/1977 | Black | 29/747 X |
| 4,102,043 | 7/1978 | Andrade et al. | 29/739 |

*Primary Examiner*—Carl E. Hall

*Attorney, Agent, or Firm*—F. M. Arbuckle; T. G. Scavone

[57] ABSTRACT

An apparatus is disclosed for automatically loading electrical contacts in the contact mounting pockets of a high density, multiple contact connector. The apparatus includes means for assembling the contacts in proper orientation for insertion into the pockets, means for transferring the contacts from the contact assembly means into an initial mounting position within the pockets, and means for seating and retaining the contacts in a final mounting position within the pockets. The apparatus provides structure to positively control the movement of the contacts throughout the loading operation to thereby minimize jamming or damage to the fragile contacts.

11 Claims, 9 Drawing Figures

FIG. 3
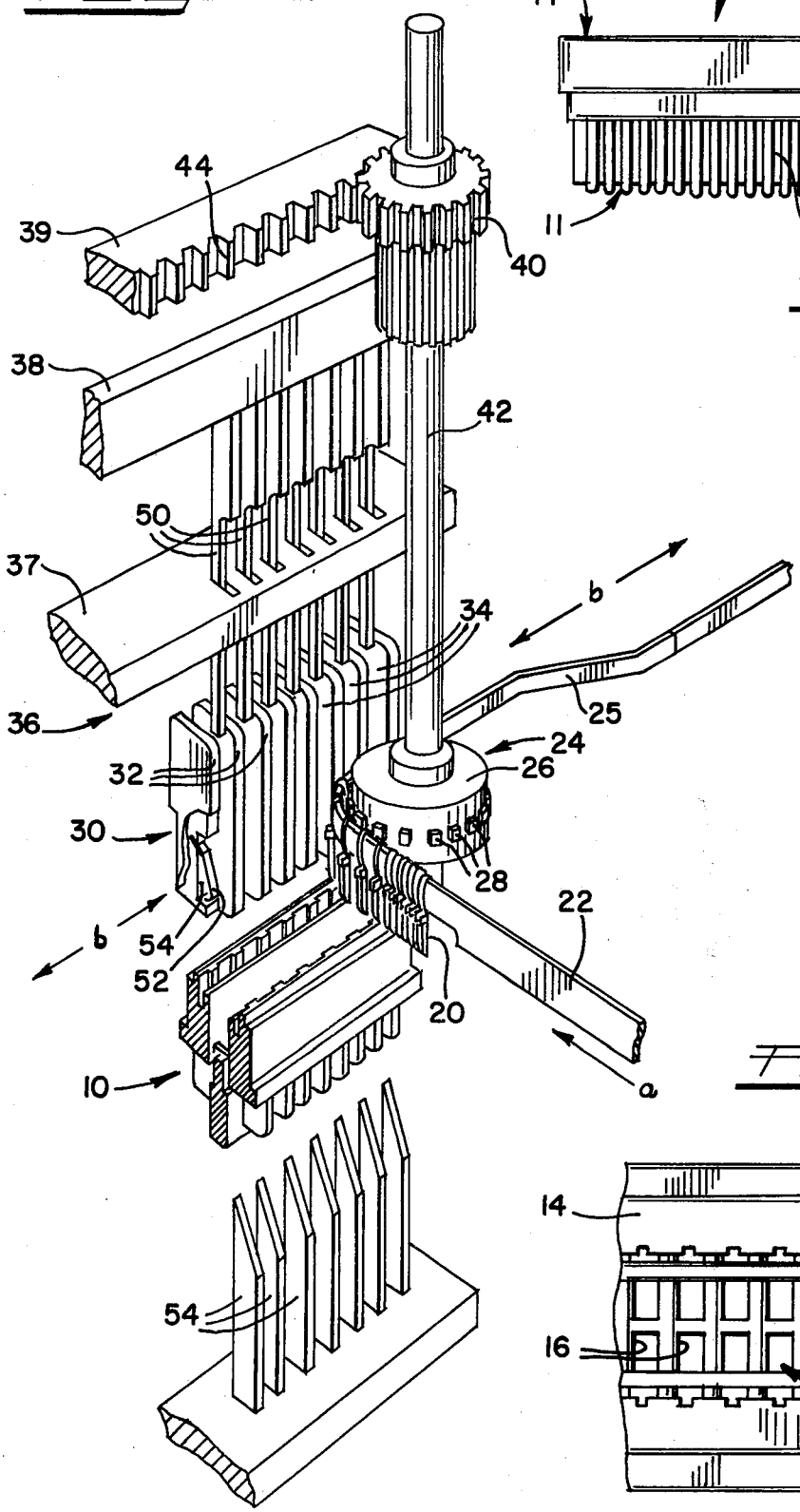
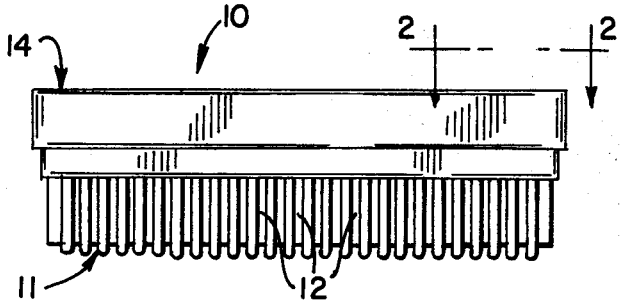
FIG. 1
FIG. 2
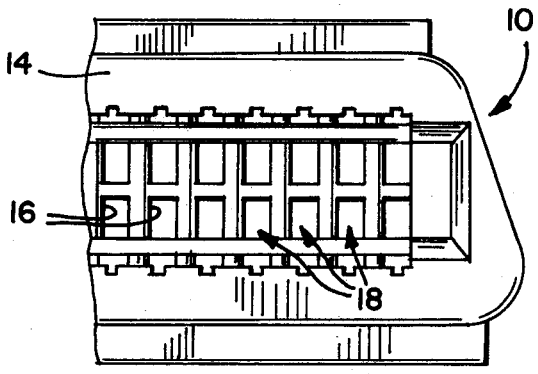

CONTACT LOADING APPARATUS

BACKGROUND OF THE INVENTION

The present invention relates generally to apparatus for assembling contacts in an electrical connector. More particularly, the invention relates to an automated apparatus for loading a plurality of individually fabricated contacts into the contact mounting pockets of a high density, multiple contact connector.

Multi-contact electrical connectors such as those disclosed in U.S. Pat. Nos. 3,867,005; 3,902,154; and 3,926,498, have been in commercial use for many years. The widespread use of these connectors in the telecommunications industry has necessitated the development of efficient and low cost methods for their mass production. While such manufacturing techniques have generally been satisfactorily developed, one particularly troublesome aspect of production has been the assembly of the individual contacts within the contact mounting pockets or cavities of the connector. Since the contacts are extremely fragile, assymetrical and not joined together on a continuous carrying strip, handling and insertion of the contacts into the connector pockets is difficult to perform with automated equipment. Accordingly, this step in the fabrication of such connectors has in the past been performed manually or with equipment requiring considerable manual assistance. As a result, the cost of the connectors is increased.

While certain automated equipment has been proposed and used to load contacts in high density, multiple contact connectors, this equipment has generally proved less than satisfactory because of jamming problems or damage to the fragile contacts during the loading operation.

SUMMARY OF THE INVENTION

Accordingly, the present invention is directed to an automated apparatus for loading individual contacts into the contact mounting pockets of an electrical connector. The apparatus requires relatively little operator assistance and employs contact handling and insertion systems which substantially eliminate the jamming and damage problems associated with prior art loading apparatus.

In accordance with the present invention, the contact loading apparatus generally comprises means for assembling a plurality of the individual contacts in proper orientation for insertion into the connector pockets, means for transferring the contacts from the contact assembly means and into an initial mounting position within the respective connector pockets, and means for seating the contacts in a finally mounted position within the connector. The contact assembly means includes means for spacing the contacts to coincide or register with the spacing of the connector pockets; the contact transfer means includes a loading comb which mechanically retains the individual contacts until they are contained within the connector pockets; and the contact seating means includes a plurality of seating punches which simultaneously engage the contacts and drive them to the final mounting position within the connector.

In addition, the apparatus may include biasing means associated with the contact transfer means to assure proper insertion of the contacts into the connector pockets and means for mechanically retaining the contacts within the insert once they are properly seated.

An important feature of the invention is that the motion of each contact is controlled by mechanically directing the contacts throughout the assembly, transfer and seating operations. As a result jamming problems caused by disoriented contacts is minimized.

Another feature of the invention is the provision of a unique contact spacing mechanism which arranges the contacts in precise registration for insertion into the contact pockets.

Still another feature of the invention is the provision of unique means to prevent jamming the contacts at the very small entry way to the connector pockets.

Finally, because each of the contact handling stations is contained in a single automated apparatus, a complete contact and connector assembly can be fabricated in a single operation.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in conjunction with the accompanying drawings in which:

FIG. 1 is a side elevational view of conventional ribbon connector dielectric insert in which the contacts are mounted with the apparatus of the present invention;

FIG. 2 is a partial plan view taken along the line 2—2 of FIG. 1;

FIG. 3 is a partially exploded perspective view showing the contact assembly, transfer and seating means employed in the apparatus of the present invention.

DETAILED DESCRIPTION OF THE INVENTION

Figure 6:
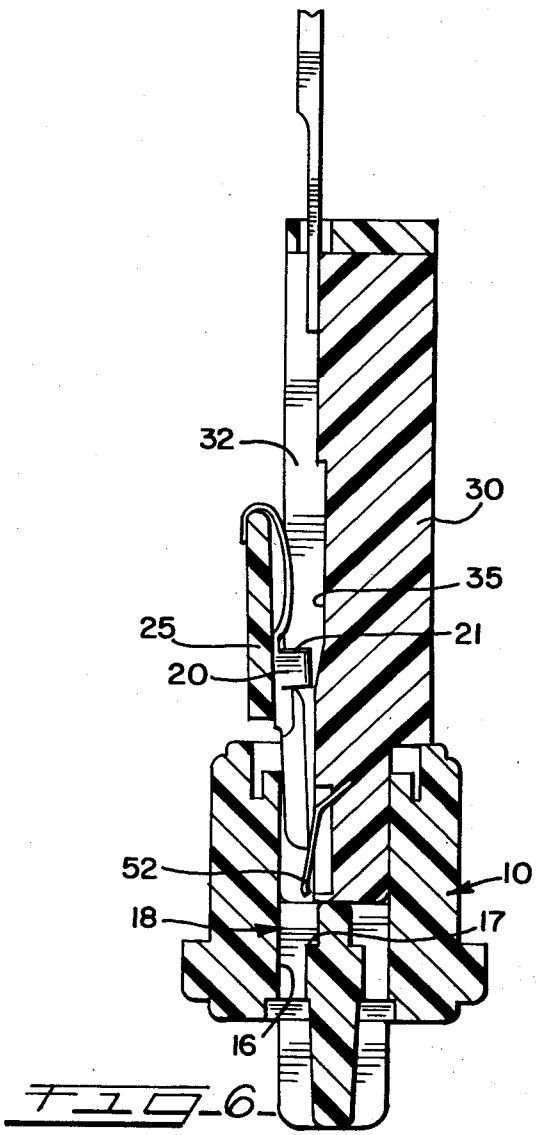
FIGS. 4–9 are enlarged cross-sectional views illustrating the handling, insertion, seating and retention of a contact in the loading operation performed by the apparatus of the present invention.
Figure 5:
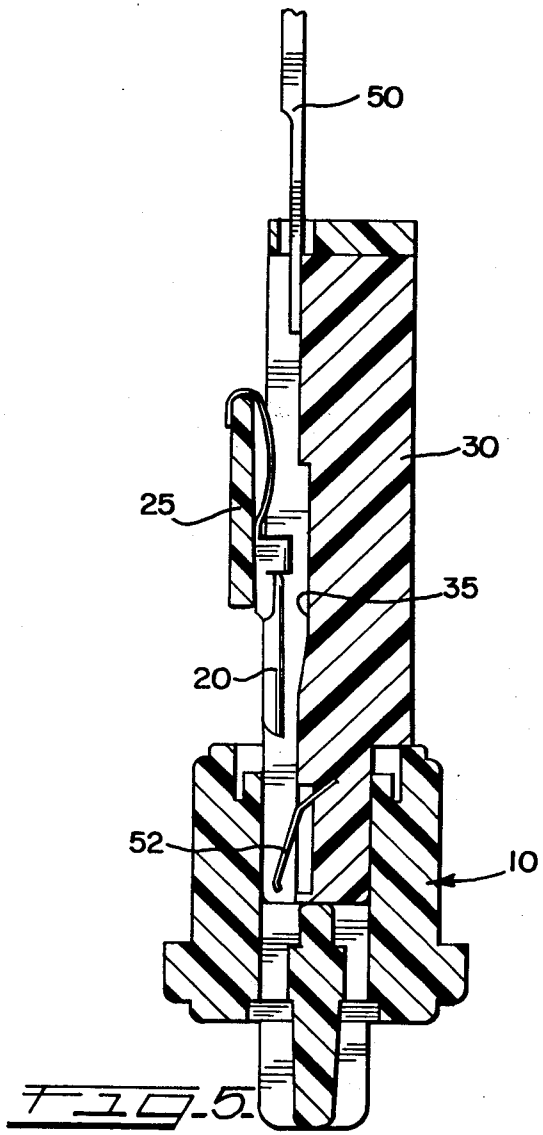
Figure 4:
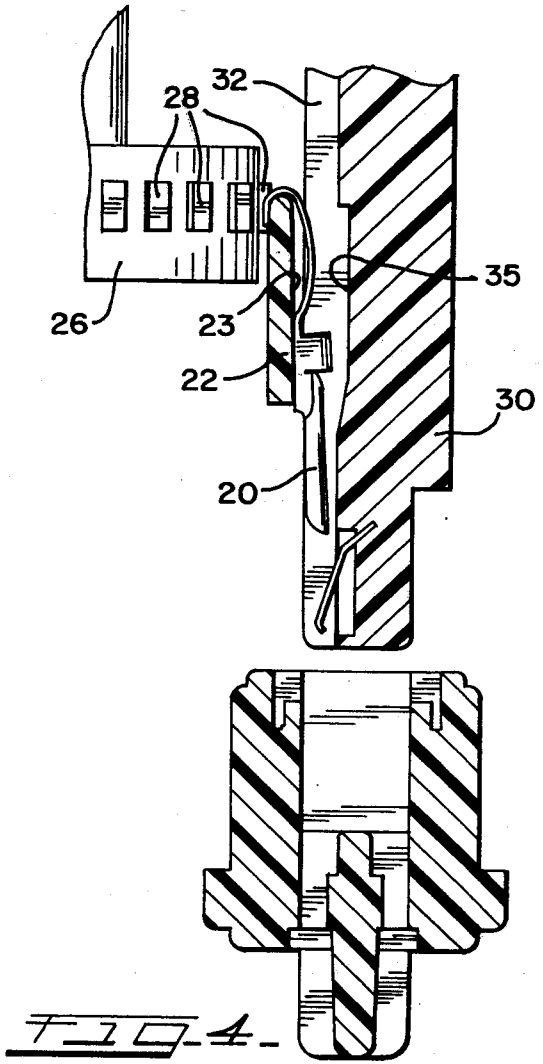
Figure 9:
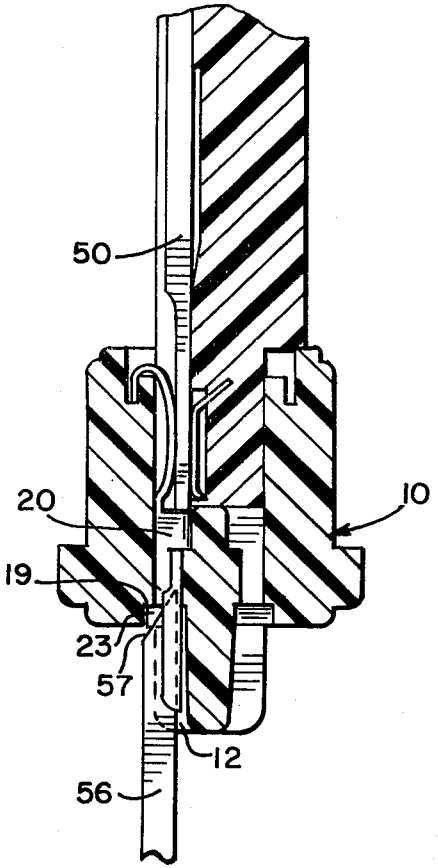

Referring now to the drawings, and particularly FIGS. 1 and 2, an empty or unloaded multiple contact connector insert 10 is shown. The illustrated insert 10 is the type used to fabricate a female or receptacle connector, but the apparatus of the present invention is equally suited for use in loading contacts in the male or plug connector. The insert 10 comprises a terminal end 11 including a series of elongated channels 12 and a mating end 14 which cooperates with a plug connector in the conventional manner. The channels 12 house the terminal portions of the contacts mounted in the insert, whereas the active portions of the contacts are disposed within the mating end 14. Thus, each of the contacts extends through one of the apertures 16 in the mid portion of the insert 10, the apertures 16 and channels 12 forming the pockets 18 of the insert. It will be appreciated by those skilled in the art that the individual contacts 20 are extremely fragile and irregular in shape, and they are not carried on a continuous strip or web but rather are loose and delivered to the loading apparatus in bulk.

The apparatus of the present invention is illustrated in FIG. 3 and generally comprises a contact assembly means, a contact transfer means and a contact seating means. Each of these stations employ unique contact handling devices which together provide an efficient, reliable mass production contact loading machine.

The contact assembly means includes a track or feeding device 22 and a contact spacing means 24. The contacts 20 are supplied from a conventional vibratory bowl feeder (not shown) and driven serially along track 22 in the direction of arrow a to the spacing means 24 which comprises a rotating member or pick-up wheel 26 having radial extensions 28. The track 22 is positioned immediately adjacent the pick-up wheel 26, thereby permitting the radial extensions 28 to engage individual contacts on the track and direct them around the 90° turn in the track and into the contact transfer means. The radial extensions 28 are circumferentially positioned on the pick-up wheel 26 such that the spacing of the contacts 20 coincides precisely with the spacing of the pockets 18 of the connector insert 10.

The contact transfer means includes a loading comb 30 having a plurality of elongated ribs or teeth 32 which define contact guide recesses 34. As the contacts 20 are directed around the curve in track 22 they are positioned within the guide recesses 34, the comb teeth 32 and the track 22 thereby forming an enclosure which positively restrains or restricts the movement of each contact 20 and maintains the contact in precise orientation for insertion into the connector insert pocket 18. The loading comb 30 is mounted to a movable carriage 36 which includes the horizontal plates 37, 38 and 39 shown in FIG. 3. The carriage 36 is adapted for reciprocal linear movement, represented by arrows b, adjacent the transfer segment 25 of track 22. During a complete operational cycle, the carriage 36 travels from an initial, forward position remote from the track 22 and spacing means 24, to an intermediate position wherein the contacts 20 are transferred to the loading comb (this intermediate position is shown in FIG. 3), and to a final, rearward contact seating position wherein the contact seating means may be activated. Of course, after the contacts have been loaded in the connector, the carriage returns to its initial position. The linear motion of the carriage 36 is synchronized with the rotary motion of the spacing means 24 through a pinion gear 40 mounted on the pick-up wheel shaft 42 and the rack 44 which is formed in plate 39 of the carriage.

The carriage 36 also includes means (not shown) for mounting the connector insert 10 to align the pockets 18 of the insert with the guide recesses 34 and carry the insert below and in fixed position relative to the loading comb 30 throughout the loading cycle. As the carriage moves rearwardly from its intermediate position, each contact is supported on track 22 and carried by the loading comb 30 along inclined transfer segment 25 whereby the contact is lowered such that its lowermost end is directed into the upper portion of pocket 18. At this point, the track 22 ends and the contact is enclosed and supported only by the comb teeth 32 and the walls of the insert pocket 18. Further rearward movement of the carriage 36 brings it to its final contact seating position.

The contact seating means employed by the apparatus of the present invention includes a plurality of punches 50 adapted for vertical reciprocal movement within the guide recesses 34 of the loading comb 30. The punches 50 are activated and move down into the recesses 34 when the carriage 36 reaches its rearwardmost final position. The punches engage each of the contacts 20 to force them from their initial mounting position to a final predetermined mounting position within the insert pocket 18. After the contacts are properly seated, the punches 50 retract and the carriage 36 may then return to its initial position in the front of the loading apparatus.

In accordance with a preferred embodiment of the invention, the loading comb 30 also includes a biasing means such as leaf spring 52 which insures that the contact 20 maintains precisely the proper orientation for insertion into the channel 12 of the insert pocket 18. Once the contact has entered into the channel 12 through aperture 16, the spring 52 is free to deflect into recess 54 and out of the path of travel of the punch 50, thereby enabling the proper cycling of the seating means.

A further preferred embodiment of the invention includes the provision of means for engaging and positioning the retention tab conventionally employed on certain ribbon connector contacts. In the illustrated loading apparatus, for example, upwardly extending blades 56 are positioned below the connector insert 10 on carriage 36. After the punches 50 have moved the contacts to their final mounting position within the pockets 18, each of the blades 56 is activated and moves upwardly through a respective channel 12 of the insert to engage the retention tab and lock each of the contents 20 in the insert. The blades 56 are then retracted from the insert simultaneously with punches 50.

The operation of the loading apparatus is further illustrated in FIGS. 4 through 9. As each individual contact is driven around the 90° turn in track 22 it is positioned within one of the recesses 34 of the loading comb 30. As these figures illustrate, the vertical movement of the contact is controlled by the track, whereas transverse or horizontal movement is restricted by the teeth 32, the back wall 35 of the recess and the side 23 of the track 22. Further movement along segment 25 of the track results in a gradual lowering of the contact 20 until it reaches the initial mounting position illustrated in FIG. 6. After this point, the track 22 ends, but the movement of the contact 20 is still controlled by walls 32 and 35 of the loading comb 30 and the interior walls of the insert 10.

Figure 8:
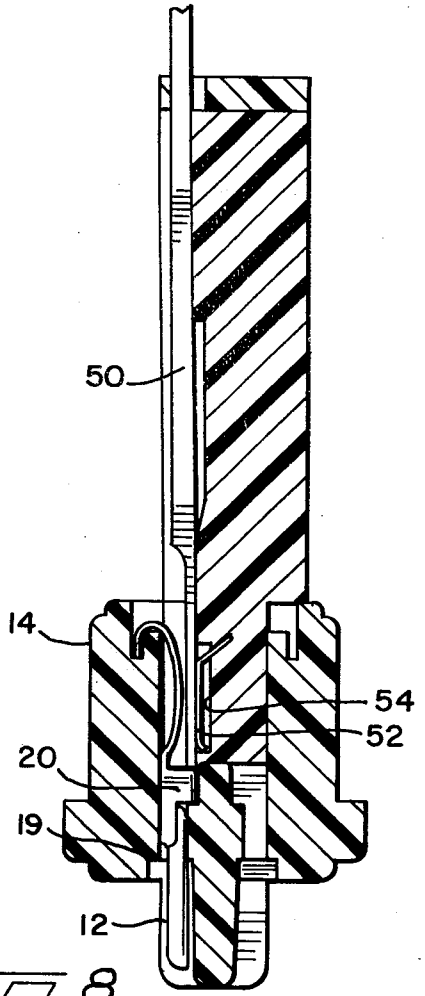
Figure 7:
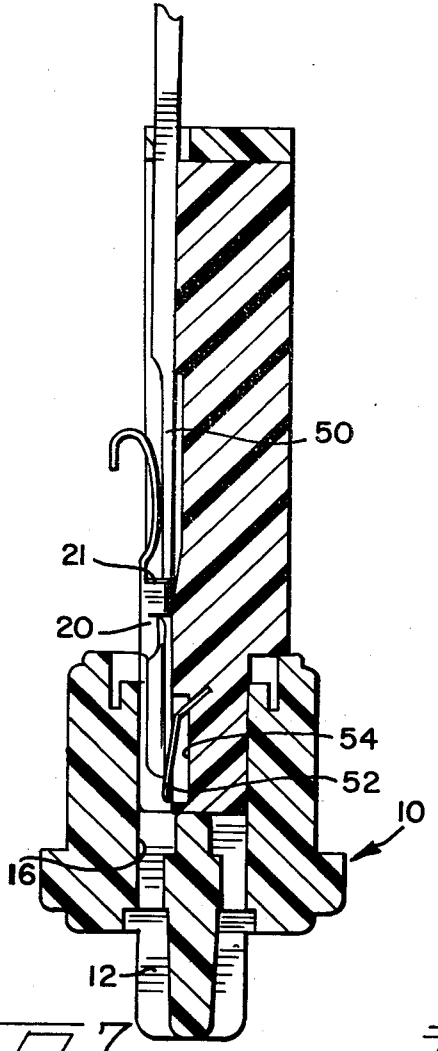

Once the carriage 36 reaches its final seating position, each of the punches 50 begins its downward travel and engages shoulder 21 of the respective contacts 20. Further travel of the punches forces the contacts into aperture 16 and ultimately into final mounting position with the contact's terminal portion nested within channel 12 and the active portion housed within the mating end 14 of the insert. Leaf spring 52 acts to direct the leading end of the contact away from ledge 17 of the insert, as can be seen in FIGS. 6–8, thereby preventing jamming or damage to the contact which might otherwise occur. However, as the punch 50 reaches the full extent of its downward travel, the spring deflects into recess 54. After each of the contacts 20 is properly seated, the blades 56 move upwardly through channels 12 and into engagement with the retention tab 23. The leading cam edge 57 of the blade 56 causes the tab to deflect and extend outwardly adjacent the shoulder 19 of the insert. This, of course, locks the contact in the insert. Finally, the punches 50 and blades 56 retract from the insert and the carriage returns to the initial forwardmost position.

It will be appreciated by those skilled in the art that the operation cycle described above relates to the loading of contacts on only one side of the conventional high density, multiple contact connector. To complete the contact loading operation, the operator merely reverses the connector insert in the carriage 36, thereby positioning the second set of insert pockets for loading with a second set of contacts. Other than this function, the operation is completely automated, and the operator is not required to handle the contacts or connector inserts during loading.

It should also be noted that the specific mechanical, electrical and pneumatic support systems and components, if any, used for actuating the various structural elements of the invention, as described above, are entirely conventional and well known to those skilled in the art of machine design. For example, the vibratory bowl feeding device, the power source and drive train for the pick-up wheel 26, punches 50 and blades 52, and the specific design of the carriage 36 would all be components well within the skill of one familiar with machine design and, as such, form no part of the present invention.

Finally, it should be understood that various changes and modifications to the preferred embodiments described herein will be apparent to those skilled in the art. For example, while the invention has been disclosed herein with regard to the loading of a specific connector insert, the apparatus may be routinely adapted to connector components of other kinds or configurations. Such changes and modifications can be made without departing from the spirit and scope of the present invention and without diminishing its attendant advantages. It is, therefore, intended that such changes and modifications be covered by the following claims.

We claim:

1. Apparatus for loading discrete electrical contacts into a plurality of pockets in an electrical connector, said apparatus comprising:

contact assembly means for assembling a plurality of contacts in proper orientation for insertion into said pockets;

contact transfer means for transferring said contacts from said contact assembly means into said pockets; and contact seating means for seating said contacts in a final mounted position within each connector pocket;

said assembly means including contact feeding means and contact spacing means, said feeding means transporting said contacts to said spacing means and said spacing means automatically separating adjacent contacts to coincide with the spacing of the connector pockets, said spacing means comprising a rotating member positioned adjacent said feeding means and having radial extensions which engage and direct individual contacts into cooperation with said contact transfer means.

2. The apparatus of claim 1 wherein said contact transfer means includes a contact loading comb having a series of guide recesses, said loading comb cooperating with said spacing means to position individual contacts in said guide recesses, and said contact transfer means positively directing said individual contacts within said guide recesses into an initial mounting position within said connector pockets.

3. The apparatus of claim 2 wherein said guide recesses of said loading comb are each alignable with a pocket of said connector, said loading comb and said connector being movable from a position at which said contacts are transferred from said spacing means into said guide recesses to a contact seating position at which said seating means act to finally position the contacts within the connector pockets.

4. The apparatus of claim 2 wherein said contact seating means includes a plurality of seating punches, said punches engaging said contacts at said initial mounting position and forcing said contacts to said final mounted position within said connector pockets.

5. The apparatus of claim 2 wherein said loading comb includes resilient means to maintain said contacts in proper loading orientation as they are directed through said guide recesses into said initial mounting position.

6. The apparatus of claim 2 further including means for supporting the contacts comprising an inclined track as the contacts travel from said spacing means to said initial mounting position within said connector pockets.

7. The apparatus of claim 1 wherein said contact feeding means comprises a supporting track along which said contacts travel serially into said spacing means.

8. An apparatus for loading a plurality of loose, discrete electrical contacts into the individual contact-holding pockets of an electrical connector, said apparatus comprising:

means comprising an elongated track for feeding the contacts serially into a contact spacing means, said contact spacing means including a rotating member having radial extension which separates the individual contacts to coincide with the spacing of said connector pockets;

means cooperating with said contact spacing means for transferring the contacts from said spacing means into the connector pockets, said transfer means including a contact loading comb and an inclined track, said comb being movable from said spacing means to a contact seating position and having guide recesses to receive individual contacts, and said track acting to support said contacts as they travel within said guide recesses from said spacing means to an initial mounting position within the connector pockets; and means for seating said contacts in a final mounting position within the connector pockets.

9. Apparatus for loading a plurality of discrete electrical contacts into a plurality of pockets in an electrical connector insert, said apparatus comprising:

contact assembly means for assembling a plurality of contacts in proper orientation for insertion into said packets, said assembly means including means for spacing said contacts to coincide with the spacing of said pockets within said connector insert;

contact transfer means cooperating with said spacing means for directing said contacts from said spacing means into an initial mounting position within said insert pockets, said transfer means including an inclined track supporting the contacts and means for mechanically controlling the movement of said contacts throughout their path of travel from said spacing means to said initial mounting position; and means for seating said contacts in a finally mounted position within each said insert pocket.

10. The apparatus of claim 9 wherein said contact transfer means includes a contact loading comb having guide recesses, said loading comb cooperating with said spacing means to position individual contacts in said guide recesses, and said loading comb being movable from said spacing means to a contact seating position at which said contact seating means act to finally position the contacts within the connector pockets, said supporting track terminating at a point intermediate said spacing means and said contact seating position.

11. The apparatus of claim 9 further including means for engaging and positioning means on said contacts to lock the contacts within said insert pockets.

* * * * *